US011375794B1

(12) United States Patent
Triplett

(10) Patent No.: US 11,375,794 B1
(45) Date of Patent: Jul. 5, 2022

(54) DEVICE FOR PULLING NOSE AND EAR HAIR

(71) Applicant: Tyson David Triplett, Provo, UT (US)

(72) Inventor: Tyson David Triplett, Provo, UT (US)

(73) Assignee: Studio 010 Inc., Provo, UT (US)

( * ) Notice: Subject to any disclaimer, the term of this patent is extended or adjusted under 35 U.S.C. 154(b) by 52 days.

(21) Appl. No.: 16/208,854

(22) Filed: Dec. 4, 2018

(51) Int. Cl.
*A45D 26/00* (2006.01)

(52) U.S. Cl.
CPC ..... *A45D 26/0047* (2013.01)

(58) Field of Classification Search
CPC ..... A45D 26/0047; A45D 26/00; A45D 26/0071; A45D 26/0052; A45D 26/009; A45D 26/0042; A45D 26/0057; A45D 26/0066; A61B 2017/00752; A61B 17/32053; A61B 2017/00969; A61B 2017/320064; A61B 17/32093; A61B 2010/0208; A61B 2017/00544; A61B 2090/034; A61B 17/50; A61B 17/28; A61B 17/2804; A61B 17/2812; A61B 17/2816; A61B 17/2841; A61B 17/2845; A61B 17/29; A61B 17/30; A61B 2017/2808; A61B 2017/2918; A61B 2017/2924; A61B 2017/505; A61B 2017/305; A61C 3/10
USPC ..... 606/133
See application file for complete search history.

(56) References Cited

U.S. PATENT DOCUMENTS

| | | | | |
|---|---|---|---|---|
| 216,918 | A | 6/1879 | Wales | |
| 1,232,617 | A | 1/1916 | Ship | |
| 1,743,590 | A | 11/1928 | Matilde | |
| 2,413,998 | A * | 1/1947 | Horatio | A45D 26/0066 606/133 |
| 2,486,616 | A | 11/1947 | Schubiger | |
| 2,458,911 | A * | 1/1949 | Kerr | A45D 26/0047 606/133 |
| 2,752,625 | A * | 7/1956 | Ponsell | A47J 45/10 15/229.13 |
| 3,971,386 | A * | 7/1976 | Yamada | A61B 17/50 606/133 |
| 4,602,631 | A * | 7/1986 | Funatsu | A61B 17/12 606/142 |
| 4,935,024 | A * | 6/1990 | Dolev | A45D 26/0028 606/133 |
| D346,862 | S * | 5/1994 | Koros | D24/143 |
| 5,355,871 | A * | 10/1994 | Hurley | A61B 17/00234 604/159 |
| 5,549,627 | A * | 8/1996 | Kieturakis | A61B 17/29 606/206 |

(Continued)

FOREIGN PATENT DOCUMENTS

| | | | |
|---|---|---|---|
| FR | 2683127 | A1 | 11/1991 |
| JP | 2010259686 | A1 | 5/2009 |

(Continued)

*Primary Examiner* — Dianne Dornbusch
(74) *Attorney, Agent, or Firm* — Goff IP Law PLLC; Jared S. Goff

(57) ABSTRACT

A hand operated device, and improvements thereof, for the removal of unwanted hairs from the nose and ears. The device comprised of a handle body and trigger assembly that, when squeezed between the thumb and fingers, remotely compresses a spring at its end. Which spring can be inserted blindly into the cavities of the nose and ears to grasp and remove the hair thereof.

17 Claims, 13 Drawing Sheets

(56) References Cited

U.S. PATENT DOCUMENTS

| | | | | | |
|---|---|---|---|---|---|
| 5,741,270 | A * | 4/1998 | Hansen | A61B 17/2909 | 606/108 |
| 5,749,886 | A * | 5/1998 | Abidin | A61B 17/3211 | 30/162 |
| 6,096,059 | A * | 8/2000 | Kuzma | A61B 17/29 | 606/208 |
| 6,106,041 | A * | 8/2000 | Eckhardt | A61B 17/50 | 294/99.2 |
| 6,159,222 | A | 12/2000 | Yiu | | |
| 6,187,026 | B1 * | 2/2001 | Devlin | A61B 17/2909 | 606/205 |
| 6,306,155 | B1 * | 10/2001 | Chandler | A61F 9/00754 | 606/170 |
| D700,698 | S * | 3/2014 | Evans | A61F 2/4611 | D24/133 |
| 9,636,480 | B2 * | 5/2017 | Sevensma | A61M 25/0041 | |
| 2004/0087973 | A1 | 5/2004 | Shobeiri | | |
| 2006/0149300 | A1 * | 7/2006 | Jessen | A61B 17/3207 | 606/167 |
| 2014/0222027 | A1 * | 8/2014 | Lucido | A45D 26/0047 | 606/133 |
| 2017/0027299 | A1 * | 2/2017 | Lucido | A61B 17/50 | |
| 2017/0265616 | A1 * | 9/2017 | Sato | A45D 26/0047 | |

FOREIGN PATENT DOCUMENTS

| | | | |
|---|---|---|---|
| WO | WO0228218 | A1 | 6/2000 |
| WO | 2002028219 | A1 | 4/2002 |

* cited by examiner

DEVICE FOR PULLING NOSE AND EAR HAIR

FIELD

The present disclosure relates to personal hair removal devices, systems, and methods, and relates particularly to hair removal from the ears and nose with improved manufacturability, quality, and user interaction.

BACKGROUND

Management of nose and ear hair is a difficult part of western grooming practices. Limited access, coupled with the inability to see into one's own nose or ear, makes the process cumbersome at best. The two most culturally accepted methods of hair removal today are cutting the hair close to the skin, or plucking the complete hair from the follicle. The trimming method typically involves expensive motorized shavers. While they effectively remove the bulk of the hair, they leave irritating stubble that requires weekly repeat trimming. Alternatively, pulling the hair solves the problem of irritating stubble and frequency of treatment, but has its own drawbacks. Tweezing is irritating, painful, and often misses hair; while waxing suffers from the expense and inconvenience of going to a salon and paying a technician.

Probably the most widely used technique for the removal of ear and nose hair is simply using the forefinger and thumb to pinch the hair and pull it out. This technique is ubiquitous and feels natural. However, limited access to the relatively small cavities of the nose and ears makes it impractical.

Therefore, there is a need for the ability to pull the complete hair from its follicle at home without the expense or inconvenience of the salon.

One general method for indiscriminately gripping and plucking hair is by the means of a tightly coiled spring. This method has been employed for more than a hundred years and is still in use today. In operation, the spring is rolled on the skin where the hair gets trapped between the coils. The rolling action draws the hair up away from the skin pulling the hair from its root. A very simple yet effective design. Unfortunately, such a device does not lend itself to use in the limited recesses of the ears and nose.

A few adaptations of this simple spring device have been contrived to address nose hair. However, none of them have proven sufficiently useful to hold a place in today's market. U.S. Published Patent Application No. U.S. Pat. No. 2,458,911A (1944) to Kerr discloses such a device. Made to be used either two handed or gripped between the first two fingers and the palm of the hand, the design is complex to manufacture, and method of use unnatural. The action used to put the device into its active (hair gripping) state is parallel to the axis of the spring. This is contrary to the pinching action one would use to pull a hair manually.

More recently, U.S. Published Patent Application No. US20140222027A1 to Lucido, and Japanese Patent Publication JP2010259686A (2010) to Yamamura filed for similar inventions. Both of these devices disclose a spring with close windings activated by the act of squeezing like a syringe. This squeezing action opens the coils of the spring allowing the hair to fall between them. The grip is then relaxed to let the coils contract and trap the hair. Both inventors failed to realize that their method of actuation is counter intuitive, squeezing to release the hair, and relaxing the grip to hold the hair for pulling. Also, the method of gripping the device like a syringe is not consistent with the typical process of plucking hairs manually.

All the above devices rely on an action parallel to the axis of the cavity of the nose or ear for actuation. This action is not consistent with the manual pulling of hair where the gripping action is exclusively perpendicular to the axis of the cavity. Accordingly, there is a need for a nose hair pulling device which utilizes a natural pinching action to grasp the nose hairs for removal.

SUMMARY

In general, the present invention provides a device that can be inserted into the nose or ear and remotely actuated to grip and remove hair.

One aspect of the disclosure relates to a nose hair puller device that uses a sliding motion to compress a spring. Wherein, a substantially cylindrical actuator shaft of a diameter is surrounded by a helically wound spring. The shaft being composed of a first end with a first end portion and a second end, the first end having a first end portion with a first end diameter that is larger than the shaft diameter. Along a mid-section of the actuator shaft is provided a first grip portion. The helical spring having a first end and a second end is composed to surround the actuator shaft and engage the first end portion of the shaft. A partially cylindrical body is provided with a first end and a second end, with an axial aperture formed therethrough. The actuator shaft is configured to be partially mounted in the axial aperture with the second end of the spring engaging the first end of the body, and configured to slide between an open position and a closed position relative to the body. The partially cylindrical body also includes a cut-out portion exposing the first grip portion of the actuator shaft and forming a second grip portion on the body. The closed position may be achieved by grasping the first grip portion and the second grip portion between a thumb and a finger and sliding the partially cylindrical body towards the first end of the actuator shaft. The shaft and the body may be returned to the open position when the opposing forces of the thumb and the finger are substantially released and the force of the spring moves the body away from the first end of the actuator shaft.

Another aspect of the disclosure is a nose hair puller device comprising, a spring actuator having a shaft with a first grip, a spring, and a body with a second grip through which the shaft is constrained to slide from a first position to a second position. In operation the first grip and second grip are grasped between a finger and a thumb. The spring is compressed by relative movement between the first grip and the second grip along the longitudinal direction of the shaft.

Another aspect of the disclosure relates to a nose hair puller device using a bendably resilient element for actuation. A helical spring having a first end and a second end is configured to surround a substantially cylindrical actuator shaft. The actuator shaft is provided with a first end, having an end portion that is larger in diameter than the shaft, and a second end slidingly coupled with a body. The body is composed of a first end, and middle portion, and a second end. In assembly, the second end of the shaft and the second end of the body are fixedly coupled, and the first body end is configured to surround the shaft. The middle body portion may be composed of at least one bendably resilient element configured to arc away from the actuator shaft when in an open position. To move the actuator shaft into a closed position the bendably resilient element is configured to be pushed into the actuator shaft, the closed position causing the helical spring to be substantially fully compressed.

Yet another aspect of the disclosure relates to a nose hair pulling device configured to be actuated by a pinching force relatively perpendicular to the longitudinal axis of the device. Wherein, a spring actuator having a shaft and a spring is axially constrained by a body. The body is composed of a first grip and a second grip. The spring is compressed by relative movement along the longitudinal direction of the shaft caused by relative movement of the spring actuator and the body. This relative movement is caused by forces on the first grip and the second grip, the forces being directed relatively perpendicular to the longitudinal axis of the shaft.

BRIEF DESCRIPTION OF THE DRAWINGS

A more complete understanding of the present invention may be derived by referring to the detailed description and claims when considered in connection with the figures.

DETAILED DESCRIPTION

Reference to the illustrated drawings, and specific language used to describe the same, should not be understood to limit the scope of the invention. Alterations and further modifications of the inventive features illustrated herein, and additional applications of the principles of the inventions as illustrated herein, which would occur to one skilled in the relevant art and having possession of this disclosure, are to be considered within the scope of the invention.

The following embodiments of the present invention described herein provide generally for a manually operated device with the purpose of gripping and pulling hairs from the cavities of the nose and ears. The device can be further simplified by describing it as a mechanism for the purpose of remotely compressing a spring. Each of these devices share three primary components: an actuator shaft, a handle, and a tweezing spring. In contrast to all other devices, each of these example embodiments is actuated by either a pinching or combination pinching and sliding force between the forefinger and the thumb. This pinching and sliding action mimics the most natural form of plucking hair and thus makes the device a natural extension to the hand.

Figure 1A:
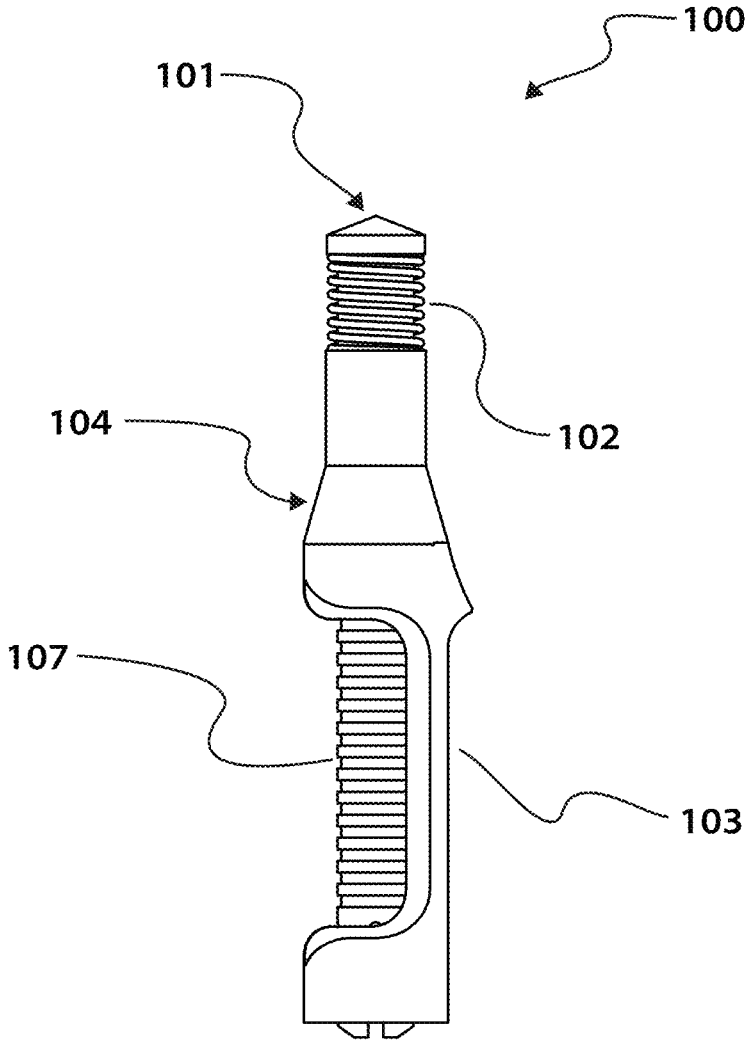
FIGS. 1*a* and 1*b* depict one embodiment of a tweezing device and how it is operated.
Figure 1B:
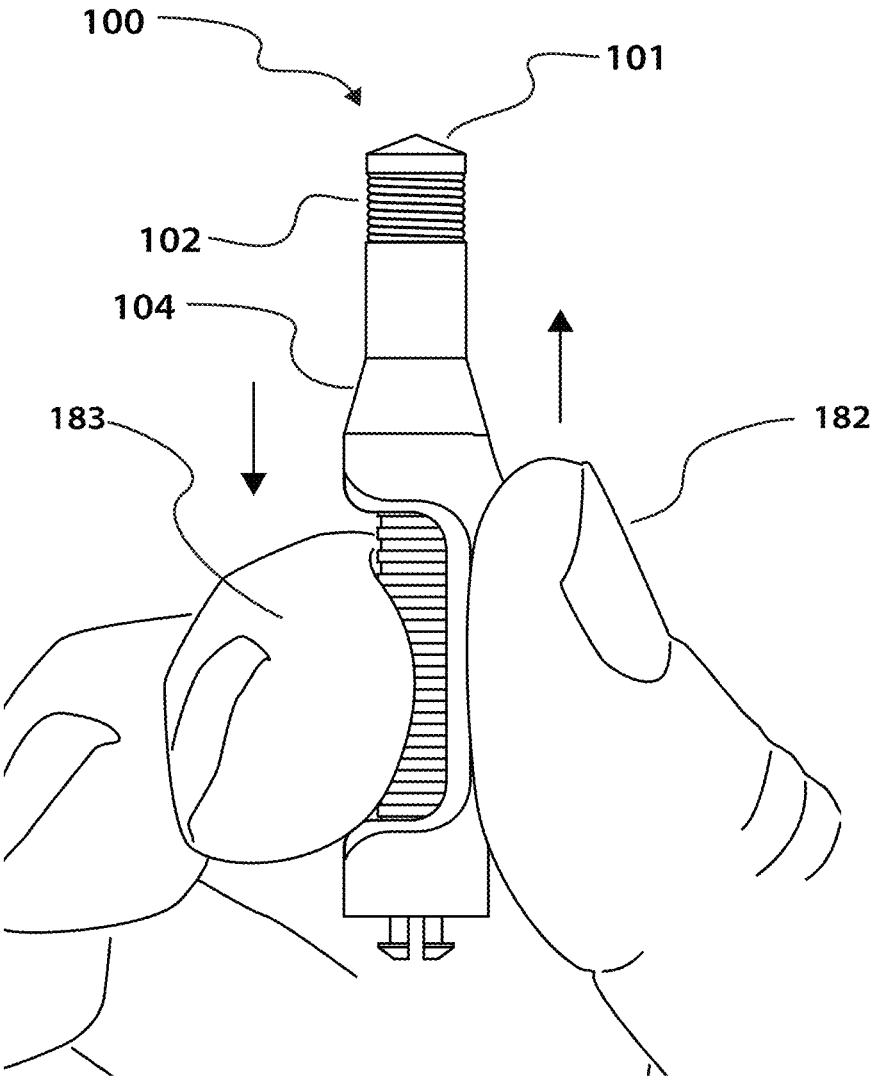

FIG. 1*a* discloses a hair plucking device 100 in its most basic form. Three parts comprise the assembly with the ultimate purpose of remotely compressing a tweezing spring 102 while it is otherwise inaccessible in the limited space of the nostril or ear canal. FIG. 1*a* Illustrates an embodiment for this device in a position with the tweezing spring 102 relaxed and the coils open. This position will be hereafter referred to as the "ready position". In FIG. 1*b* we see the actuator shaft 101 drawn into the handle body 104 compressing the spring 102. This position hereafter will be referred to as the "gripping position".

In FIG. 1*b* the device is brought into the gripping position by pinching and sliding the device between the thumb 182 on a handle body grip 103 (FIG. 1*a*), and the forefinger 183 positioned on an actuator shaft grip 107 (FIG. 1*a*). This action drives the actuator shaft 101 telescopically into the handle 104 and substantially compresses the spring 102.

Figure 2A:
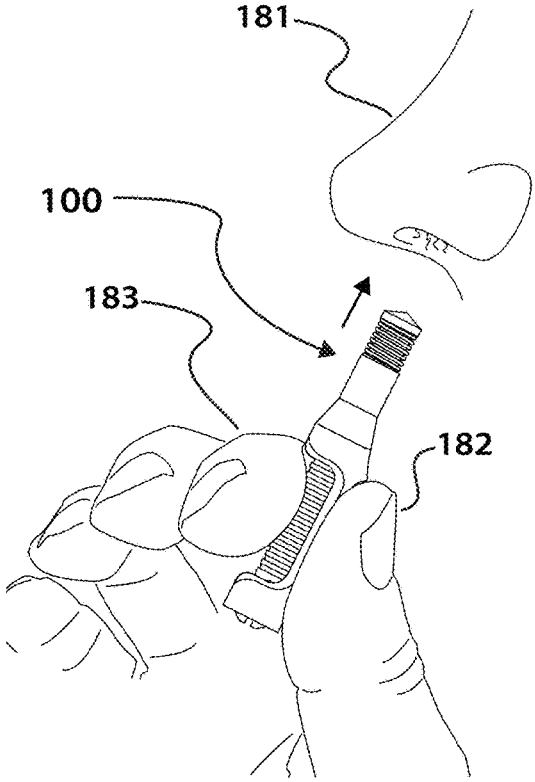
FIGS. 2*a*, 2*b*, 2*c*, and 2*d* illustrate one method for removing unwanted nose hair.
Figure 2B:
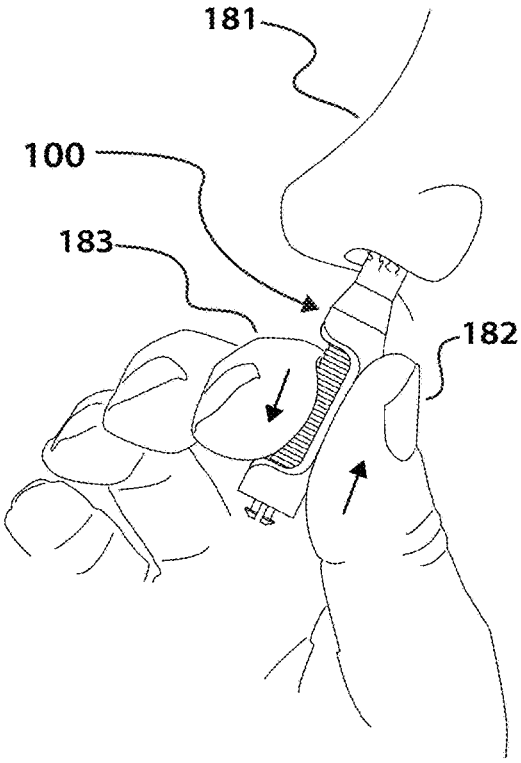
Figure 2C:
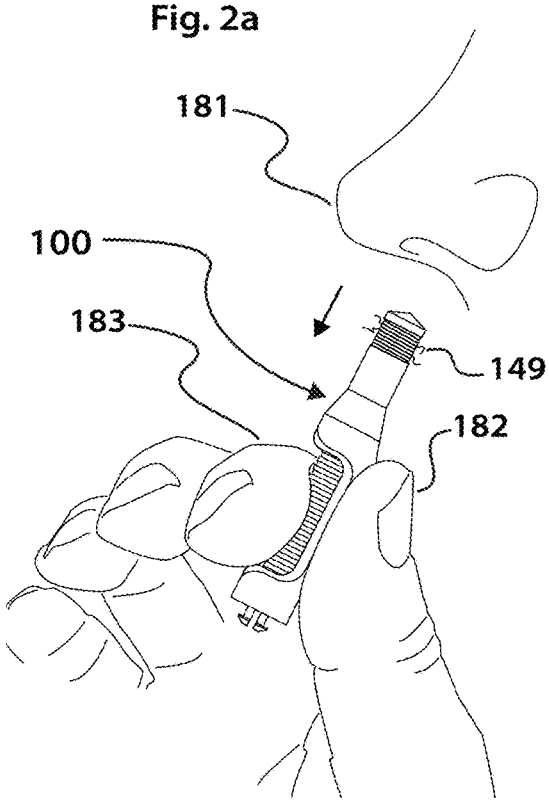
Figure 2D:
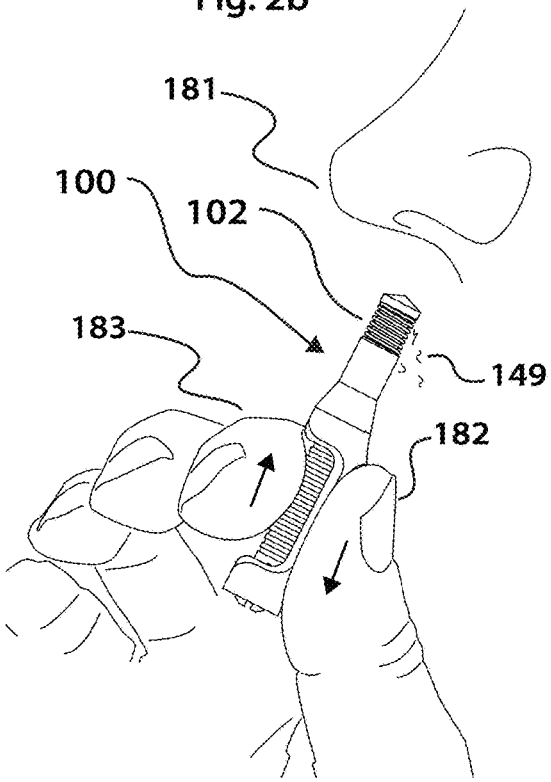

In use, operation is rather straight forward. The operator starts (FIG. 2*a*) by holding the device 100 lightly between the thumb 182 and the forefinger 183. The spring end is inserted into the cavity of the nose 181. FIG. 2*b* shows the device 100 being activated by applying a pinching/sliding force between the thumb 182 and the finger 183 bringing the spring into its gripping position. While holding the gripping position (FIG. 2*c*) the device is rapidly withdrawn from the nose 181 bringing with it all the trapped hair 149. In the final step (FIG. 2*d*), the pinching force is released, the spring 102 is allowed to relax moving the assembly back to its ready position, and the hair 149 is released from the spring 102.

Figure 3A:
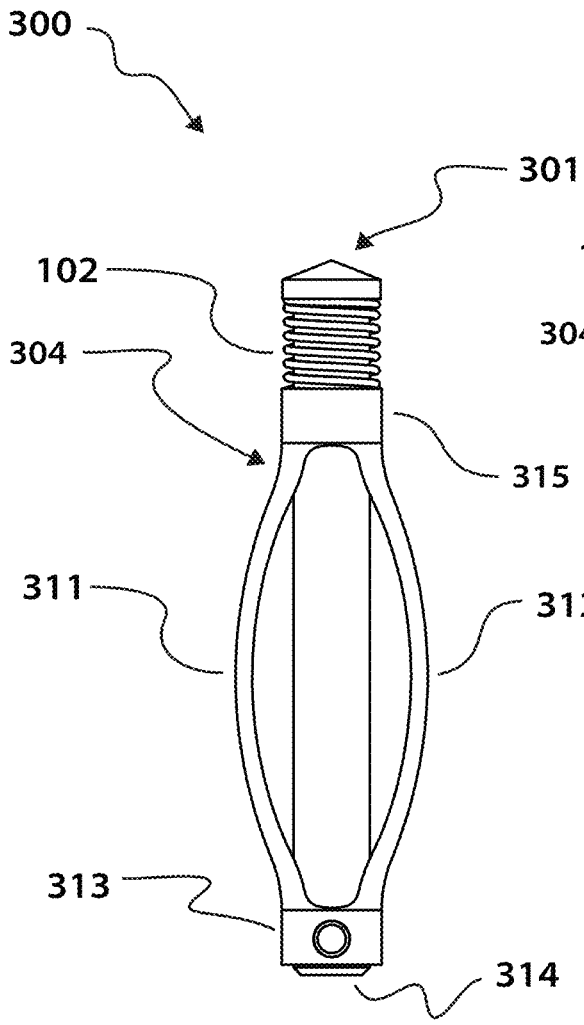
FIGS. 3*a* and 3*b* depict another embodiment of the invention in both its passive and active state.
Figure 3B:
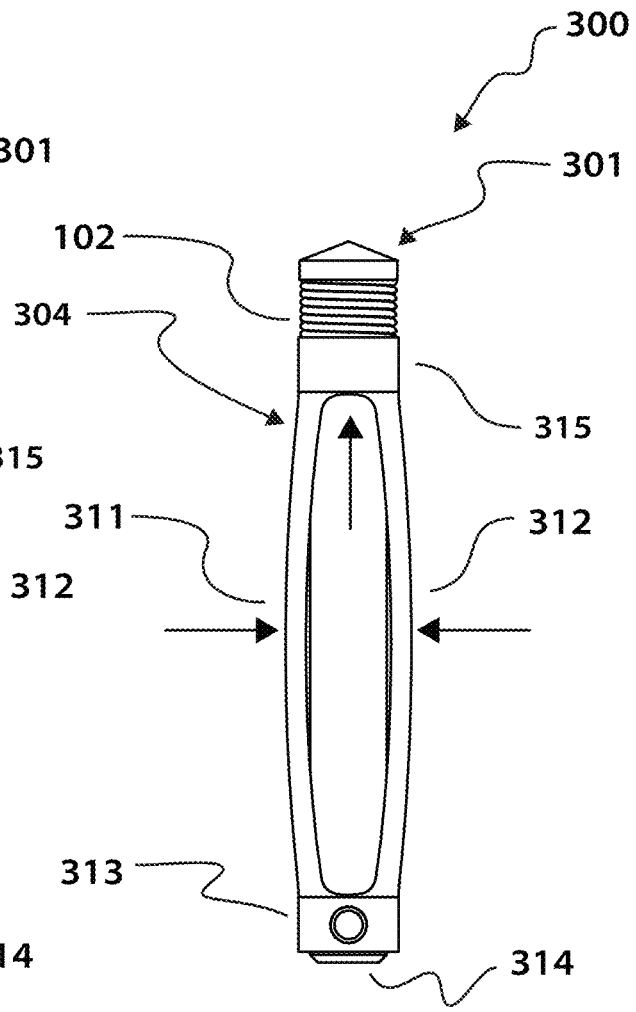

FIG. 3*a* and FIG. 3*b* show another simple three part embodiment where a handle body 304 is composed of a compliant material, such as plastic, so as to change axial length when pinched on its middle. The device 300 is constructed by threading the spring 102 and the handle 304 onto a shaft 301. The stationary end of the handle 313 is joined to the stationary end of the shaft 314. In use, the handle 304 is pinched between the first grip 311 and the second grip 312 forcing the handle 304 to elongate (FIG. 3*b*). The free end 315 of the handle 304 travels along the shaft 301 away from the fixed end 313 compressing the spring 102 bringing the device 300 into the gripping position.

Figure 4A:
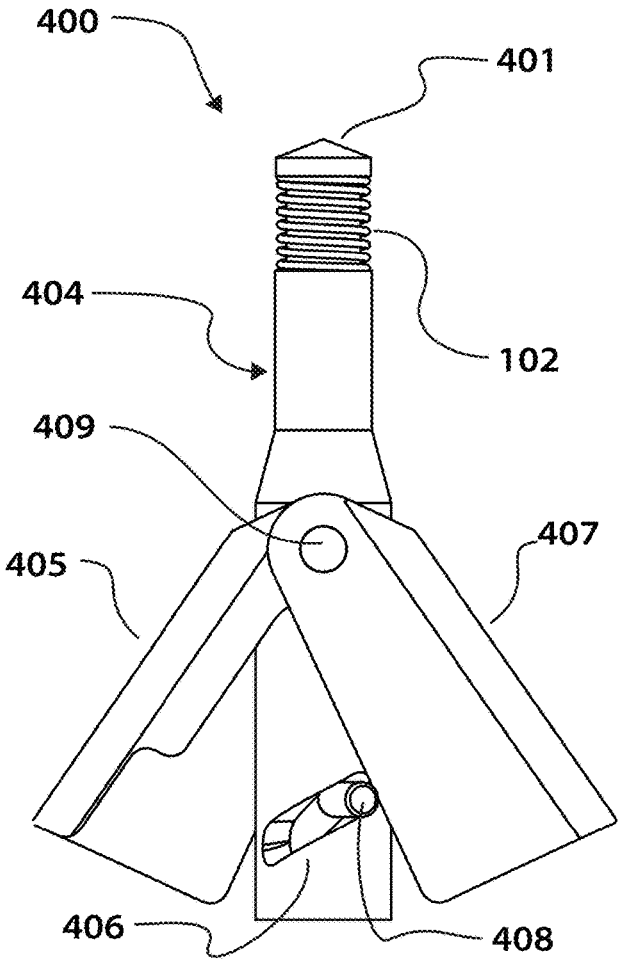
FIGS. 4*a* and 4*b* illustrates another embodiment where the device is actuated by a screwing action.
Figure 4B:
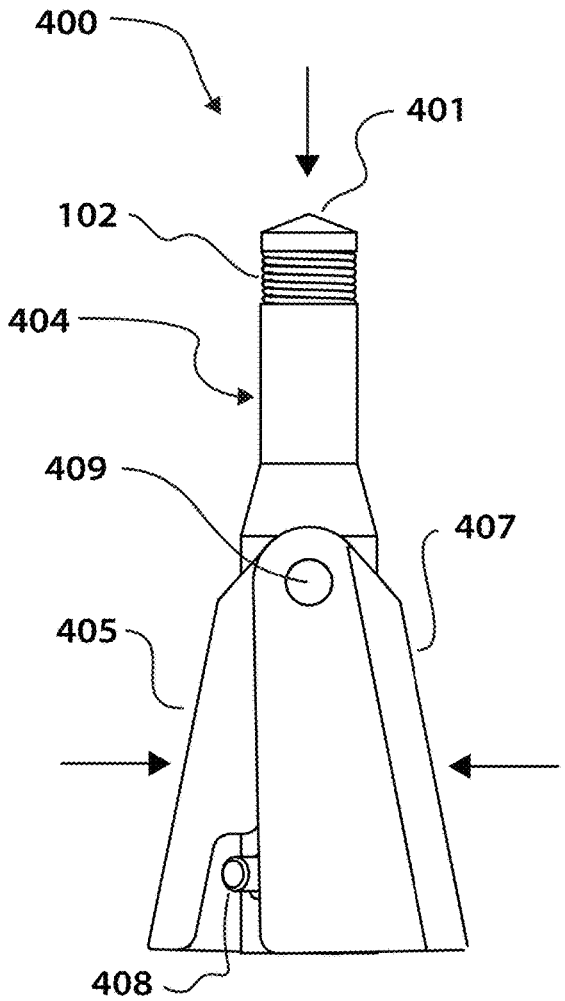

Another embodiment of the invention is illustrated in FIG. 4*a* and FIG. 4*b*. Here a device 400 comprises five unique parts: an actuator shaft 401, a tweezing spring 102, a handle body 404, two actuating levers 405 and 407, and a follower pin 408. The handle is equipped with a pivot 409 and a ramping slot 406. In assembly, the spring 102 is arranged between the shaft 401 and the handle 404 in coaxial engagement. This base assembly is held together by means of the pin 408 passing through the slot 406 and affixed in a hole in the end of the shaft 401. The two levers 405 and 407 are affixed to either side of the handle 404 by means of the pivot 409. To operate the device 400 (FIG. 4*b*) the levers 405 and 407 are pinched perpendicular to the longitudinal axis of the device 400. As the levers 405 and 407 rotate about the handle pivot 409 they impinge on the pin 408 and drive it through the slot 406. The ramping nature of the slot 406 guides the pin 408 downward drawing the shaft 401 telescopically into the handle 404 compressing the spring 102 and bringing the device 400 into the gripping position.

Figure 5A:
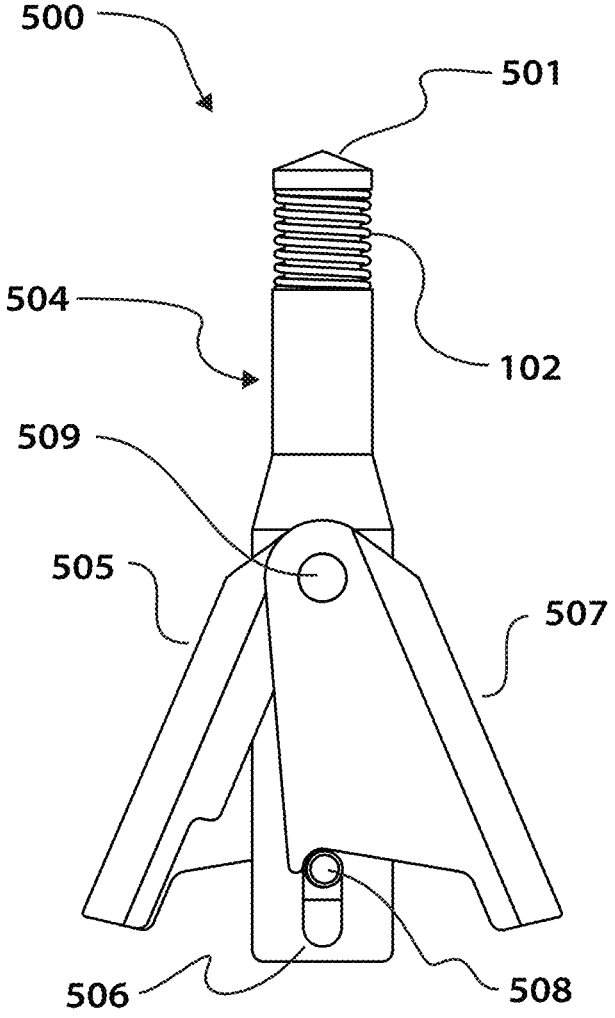
FIGS. 5*a* and 5*b* depicts an embodiment where the device is actuated by an inclining ramp.
Figure 5B:
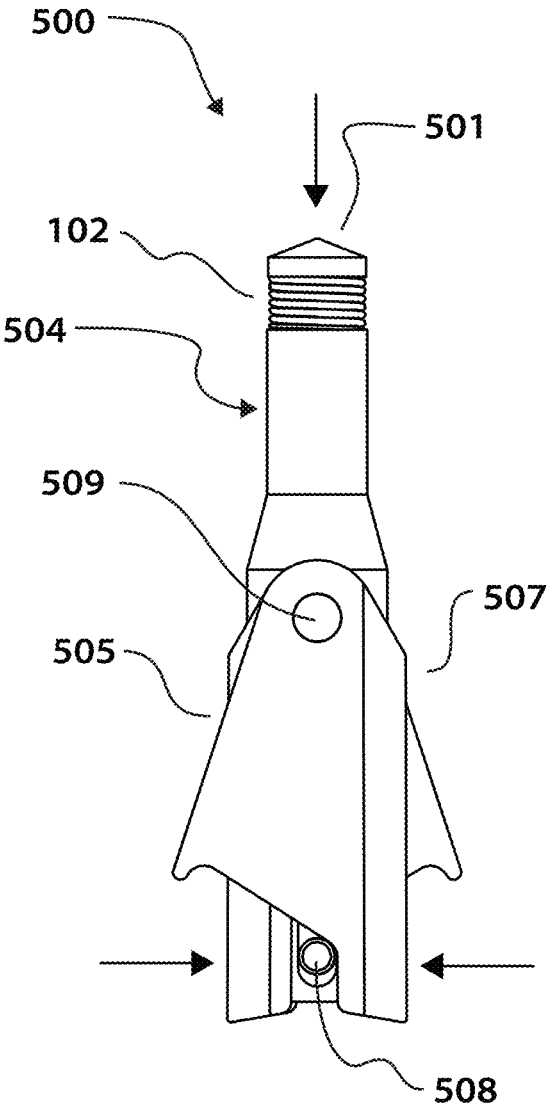

Another embodiment of the present invention is illustrated in FIG. 5*a* and FIG. 5*b*. Here the device 500 includes five unique parts: an actuator shaft 501, a tweezing spring 102, a handle body 504, two ramped actuating levers 505 and 507, and a follower pin 508. The handle is equipped with a pivot 509 and a guide slot 506. In assembly, the spring 102 is arranged between the shaft 501 and the handle 504 in coaxial engagement. This base assembly is held together by means of the pin 508 passing through the slot 506 and affixed in a hole in the end of the shaft 501. The two levers 505 and 507 are affixed to either side of the handle 504 by means of the pivot 509. To operate the device 500 the levers 505 and 507 are pinched (FIG. 5*b*) perpendicular to the longitudinal axis of the device 500. As the levers 505 and 507 rotate about the handle pivot 509 they impinge on the pin 508. The ramping profile of the levers 505 and 507 push the pin 508 away from the pivot 509. Guided by the slot 506 the pin 508 and connected shaft 501 are drawn into the handle 504 compressing the spring 102 and bringing the whole assembly 500 into the gripping position.

Figure 6A:
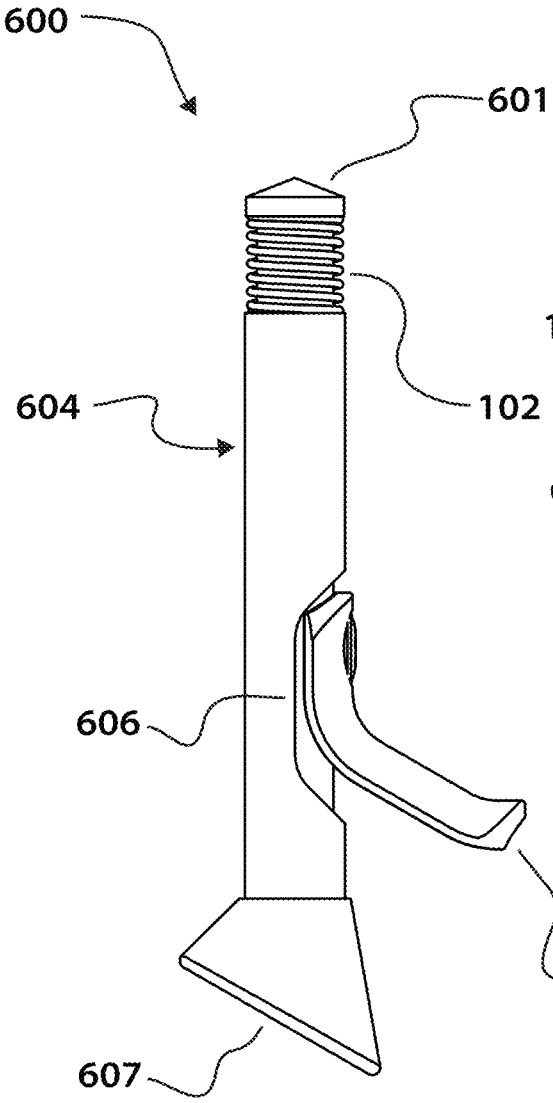
FIGS. 6*a* and 6*b* depict a direct acting mechanism for actuation of the device.
Figure 6B:
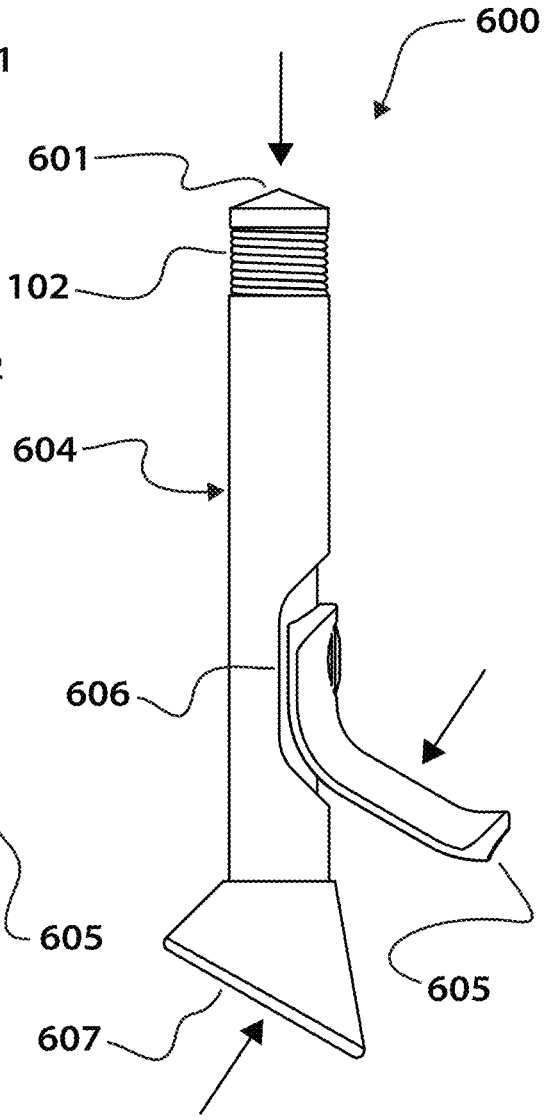

In previous embodiments the pinching force has been applied to a device substantially perpendicular to the longitudinal axis of action. It may be advantageous to provide a device where the pinching force can be applied at a predetermined angle relative to the action. In FIG. 6*a* and FIG. 6*b* a device 600 with an angled grip is shown. This device 600 includes four primary parts: an actuator shaft 601, a tweezing spring 102, a handle body 604, and a trigger 605. The handle body is composed of a tubular structure with a slot 606 and a butt grip 607. In assembly the spring 102 is arranged between the shaft 601 and the handle 604 in axial engagement. The trigger 605 is then affixed to the shaft 601 through the slot 606. To operate (FIG. 6*b*), the device 600 is pinched together by the trigger 605 and the butt grip 607. The trigger 605, being affixed to the shaft 601, draws the handle 604 and the shaft 601 together compressing the spring 102 and bringing the device 600 into the gripping position.

Figures 7A, 7B:
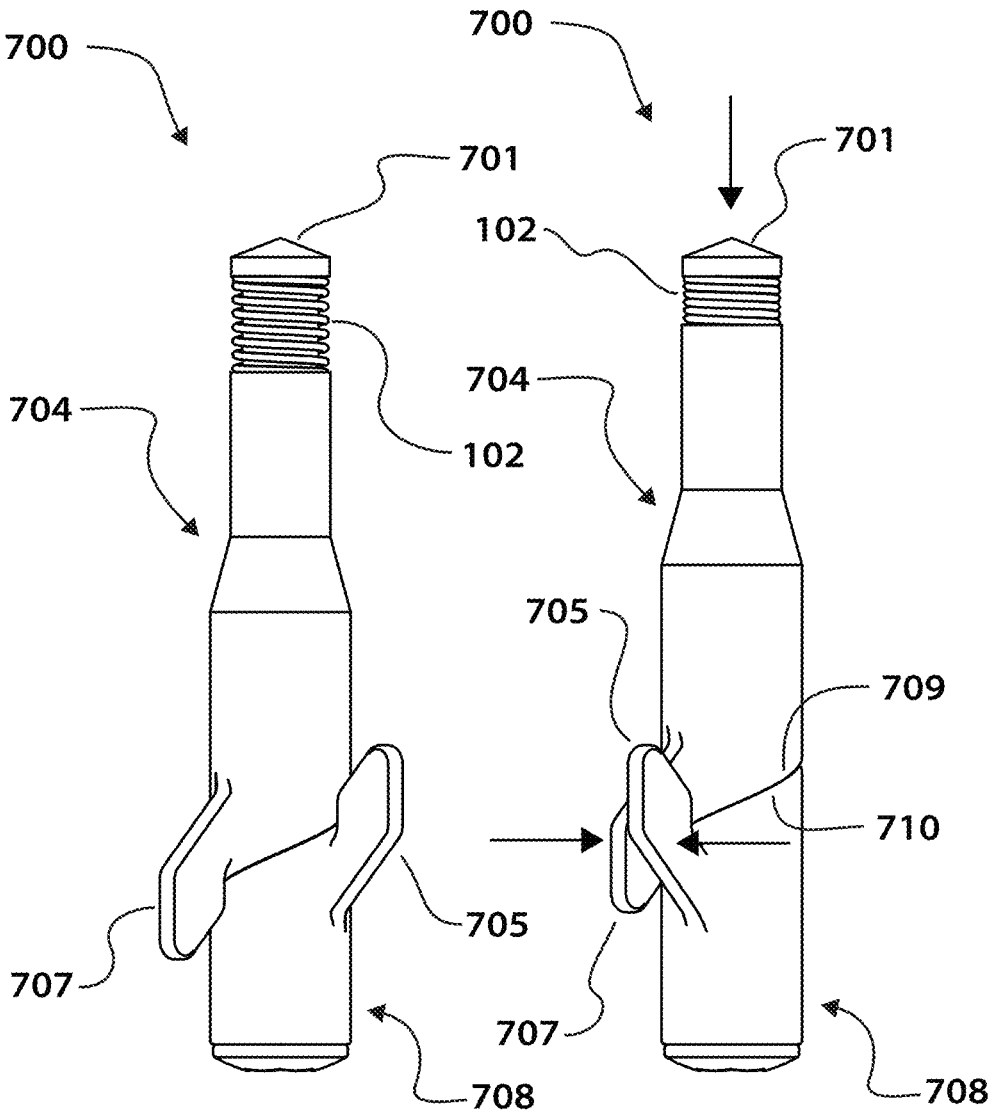
FIGS. 7*a* and 7*b* illustrate a ramping mechanism employed to actuate the device.

FIG. 7*a* and FIG. 7*b* illustrate an embodiment where a screwing action is used to translate a pinching motion to compress a tweezing spring 102. The device 700 includes four primary parts: an actuating shaft 701, a tweezing spring 102, an actuating handle 704, and a butt handle 708. In FIG. 7*b* the actuating handle 704 and the butt handle 708 are provided with a helical ramp 709 and 710 designed to mate with each other, and grip wings 705 and 707 for actuation. The shaft 701 is affixed to the butt handle 708 such that they move together axially. The device 700 is operated by pinching the grip wing 705 of the actuating handle 704 together with the grip wing 707 of the butt handle 708 such that the two drive against each other by means of the helical ramps 709 and 710. In this manner the shaft 701 is driven down in relation to the actuating handle 704 bringing the spring 102 into a substantially compressed state with the device 700 in the gripping position.

Figures 8A, 8B:
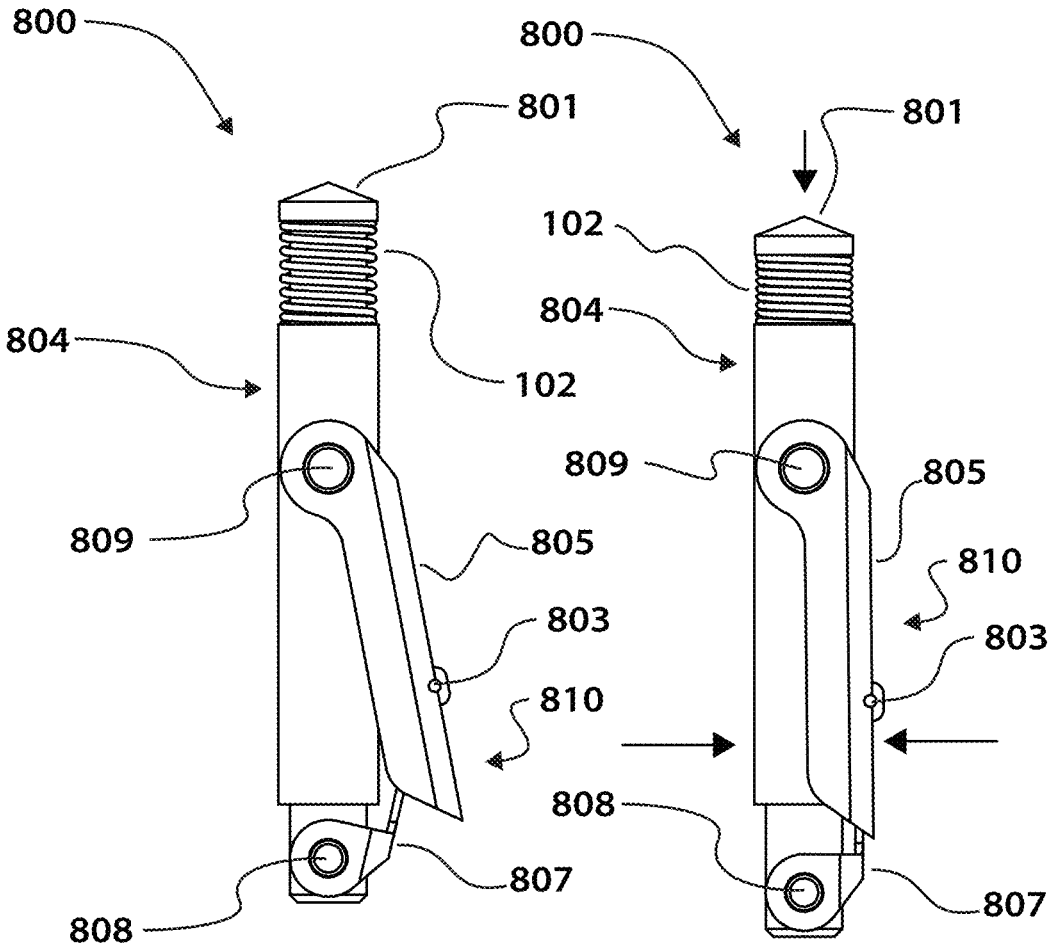
FIGS. 8*a* and 8*b* depict actuation by means of a toggle action.

Yet another embodiment is exemplified in FIG. 8*a* and FIG. 8*b*. In these figures a device 800 is equipped with a toggle mechanism 810. The device 800 includes an actuator shaft 801, a tweezing spring 102, a handle body 804, and the toggle mechanism 810. The toggle 810 includes two arms, a primary arm 805 and a secondary arm 807 which are connected to each other by means of a central pivot 803. The completed assembly 800 is constructed by threading the spring 102 and the handle 408 axially onto the shaft 801, and connecting the primary 805 and the secondary 807 arms of the toggle 810 to their respective pivots on the handle 809 and the shaft 808. With the assembly complete the device 800 is gripped by the primary arm 805 and the handle body 804. When force is applied (FIG. 8*b*), the toggle 810 collapses about the central pivot 803. This action drives the axle pivot 808 and the handle pivot 809 away from each other. As a result, the handle body 804 travels along the shaft 801 and compresses the spring 102 bringing the device 800 into the gripping position.

Figure 9A:
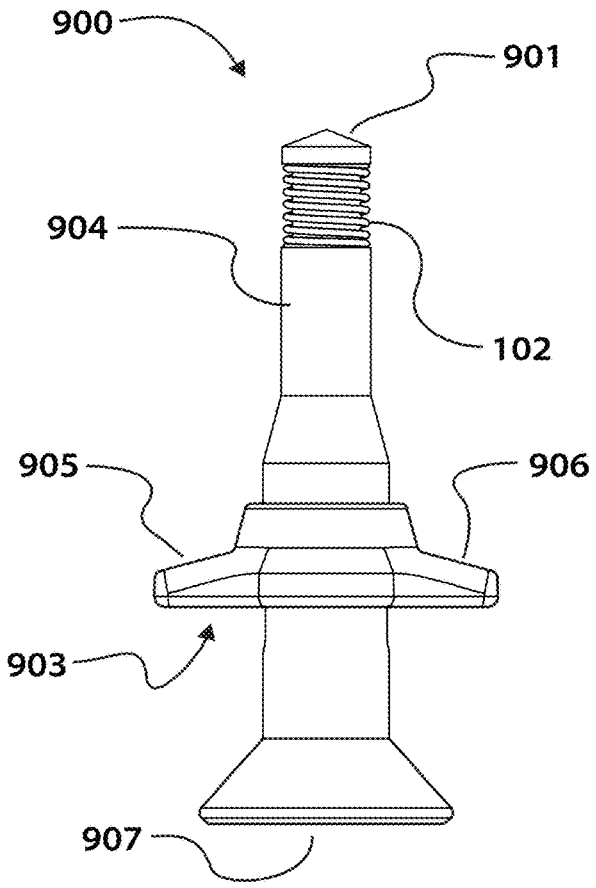
FIGS. 9*a* and 9*b* depict another embodiment of the device in the passive and active state.
Figure 9B:
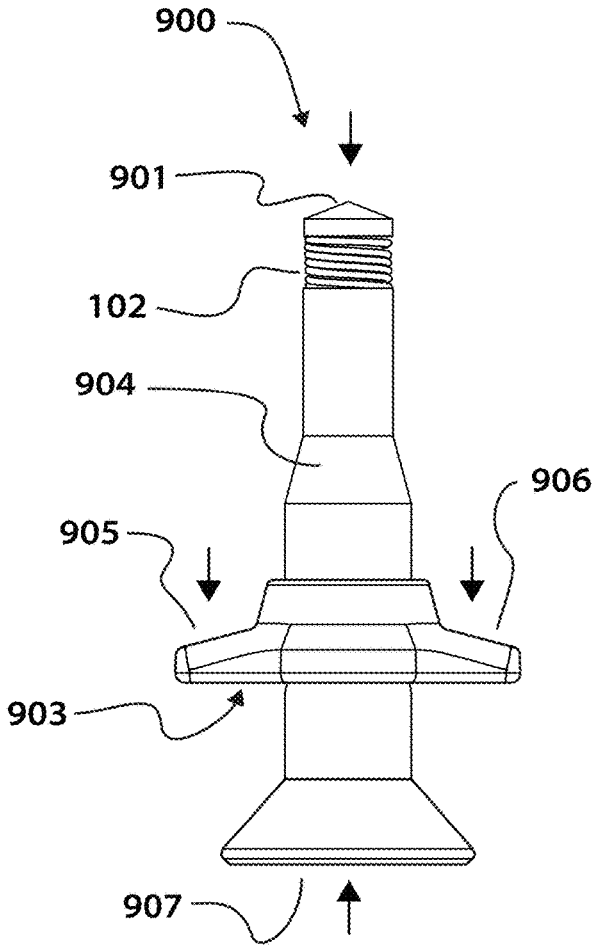
Figure 9C:
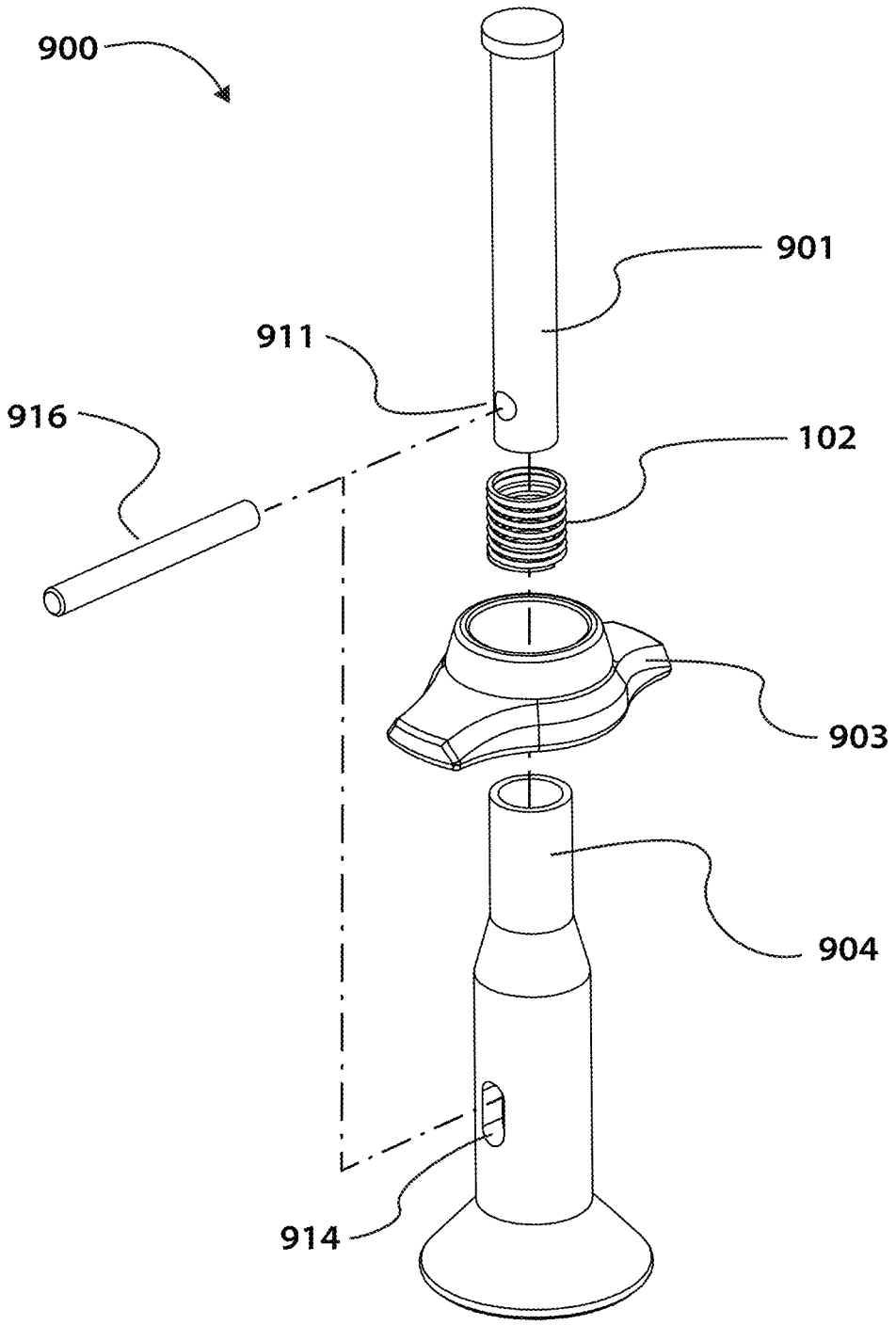
FIG. 9*c* illustrates the device of 9*a* and 9*b* in an exploded view showing each component and how they are assembled.

Another embodiment illustrated in FIG. 9*a*, FIG. 9*b*, and FIG. 9*c* shows how one might add an extra gripping surface to increase stability in operation. As can be seen in FIG. 9*c*, a device 900 includes five primary components: an actuator shaft 901, a handle body 904, a spring 102, a dowel pin 916 and a trigger 903. The shaft 901 is equipped with a hole 911, and the handle 904 provided with a slot 914. In assembly the spring 102 and handle 904 are brought into axial engagement with the shaft. To secure the assembly 900 together, and provide a means to act upon the shaft 901, a pin 916 is placed through the slot 914 and the hole 911. To fix the pin 916 and give the operator a larger gripping area a trigger 903 is provided. The trigger 903 slips onto the handle 904 and traps the pin 916.

To operate the device 900 in FIG. 9*a* the user grips the device between the thumb on a butt grip 907, the first finger on a first trigger grip 905, and the second stabilizing finger on a second trigger grip 906. In FIG. 9*b* force is applied to the trigger 903 opposite the butt grip 907 the adjoining trigger 903, pin 916 and shaft 901 all move relative to the handle 904 compressing the spring 102 and bringing the device 900 into the gripping position.

Figure 10:
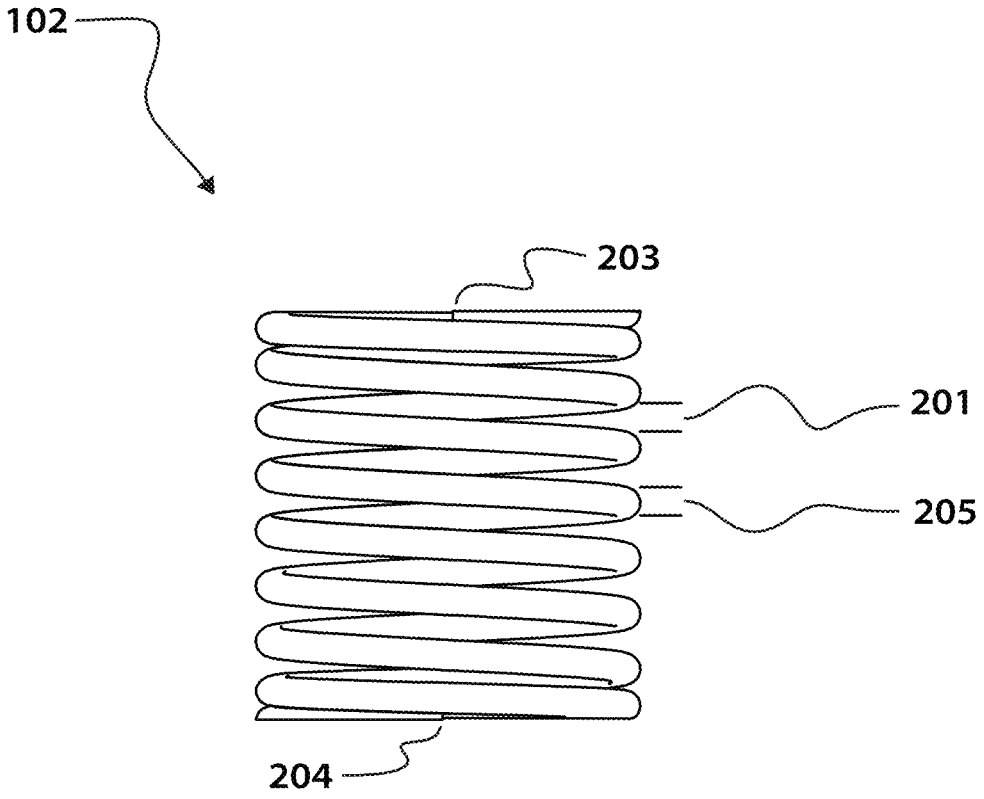
FIG. 10 illustrates a spring designed specifically for hair plucking.

For a device of the present invention to function properly, a purpose built spring 102 must be constructed. FIG. 10 illustrates a spring where the spring 102 coils, in their ready position exhibit a wire diameter 205 to air gap 201 ratio within the limits of 0.8:1 to 1:1.2. This ratio ensures that the spring deforms as little as necessary when forced into its gripping position. Also outlined in FIG. 10, the spring 102 is composed of a start 203 and an end 204. To minimize gaps between coils when compressed the cross sectional volume of the spring 102 must be substantially balanced. To best balance coil volume in the spring 102 the start 203 and the end 204 should be no less than 330 radial degrees and no more than 360 degrees out of phase in respect to the other.

Figure 11A:
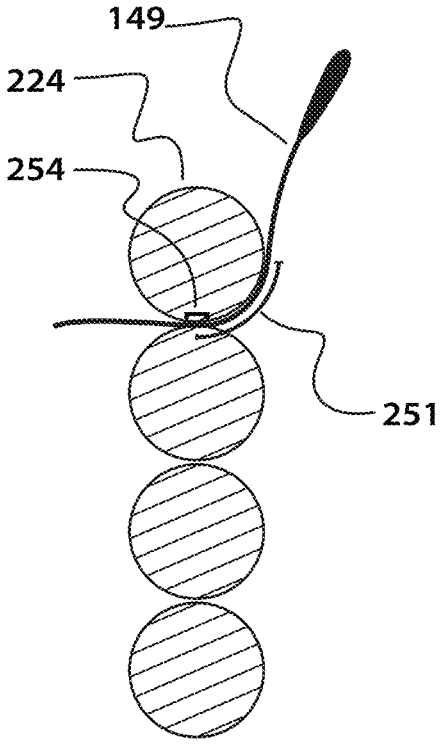
FIG. 11*a* depicts a magnified cross sectional view of the spring detailing the round profile of the spring wire.
Figure 11B:
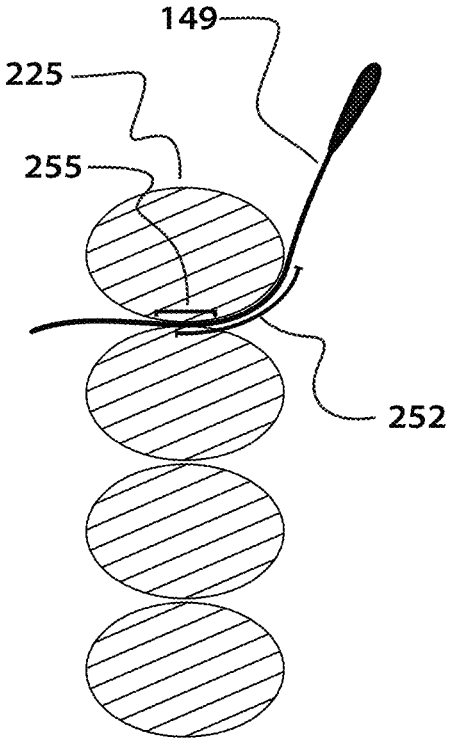
FIG. 11*b* depicts a magnified cross sectional view of the spring detailing an ovoid profile of the spring wire.

To enhance gripping action and reduce the instance of hair breakage. FIG. 11*a* and FIG. 11*b* show the cross section of a spring 102 wound having a round profile 224, and an alternate design with an ovoid profile 225. In FIG. 11*a* the relatively small radius 251 of the round wire profile 224 focuses the plucking stress on a relatively short linear area 254 of the hair 149. Alternately, the tweezing spring 102 in FIG. 11*b*, having an ovoid cross section 225, puts less stress on the hair 149 by spreading the pulling force over a greater linear area 252. As a result, the pulling force on the hair 149 is not as localized resulting in fewer broken hairs 149. Furthermore, the relatively small gripping area 254 of the round profile 224 is not as effective as the larger gripping area 255 of the ovoid wire 225.

Finally, the present invention has been described above with reference to various exemplary embodiments. However, many changes, combinations and modifications may be made to the exemplary embodiments without departing from the scope of the present invention. For example, the various components may be implemented in alternate ways. These alternatives can be suitably selected depending upon the particular application or in consideration of any number of factors associated with the operation of the system. In addition, the techniques described herein may be extended or modified for use with other types of devices. These and other changes or modifications are intended to be included within the scope of the present invention.

What is claimed is:

1. A hair puller, comprising:

an actuator shaft having a first actuator end and a second actuator end, the first actuator end having a first actuator end portion extending laterally outward;

a helical spring having a first spring end and a second spring end, the helical spring surrounding the actuator shaft, the first spring end of the helical spring engaging the first actuator end portion of the actuator shaft, the helical spring being configured to receive hairs into the helical spring, and the helical spring being configured to grip the hairs in the helical spring as the helical spring moves to a substantially fully compressed configuration; and a body having a first body end, a middle body portion, and a second body end, the first body end engaging the second spring end and the first body end slidingly coupled with the actuator shaft, the middle body portion including at least one bendably resilient element configured to extend away from the actuator shaft when in an open position and the at least one bendably resilient element configured to be pushed towards the actuator shaft in moving from the open position to a closed position, the moving from the open position to the closed position comprising moving the helical spring to the substantially fully compressed configuration, the moving from the open position to the closed position causing the first body end to move axially along the actuator shaft in a direction toward the helical spring.

2. The hair puller of claim 1, wherein the helical spring is wound with a substantially 1:1 wire diameter to air gap ratio.

3. The hair puller of claim 1, wherein the helical spring is wound with a wire diameter to air gap ratio in a range of approximately 0.66 to 1.

4. The hair puller of claim 1, wherein the helical spring is formed of a spring wire and the first spring end and the second spring end are no less than 330 degrees and no more than 360 degrees out of phase in a helix.

5. The hair puller of claim 1, wherein the helical spring is formed of a spring wire and a cross section of the spring wire of the helical spring is substantially oval.

6. The hair puller of claim 1, wherein the hair puller is comprised of exactly three parts that are moveable relative to each other.

7. The hair puller of claim 1, wherein the at least one bendably resilient element comprises at least two bendably resilient elements.

8. The hair puller of claim 1, wherein the helical spring is located axially between the first actuator end portion of the actuator shaft and the at least one bendably resilient element.

9. The hair puller of claim 1, wherein the second body end is fixedly coupled to the second actuator end.

10. The hair puller of claim 1, wherein the at least one bendably resilient element comprises two bendably resilient elements positioned on opposite sides of the actuator shaft, wherein a single continuous part comprises the two bendably resilient elements.

11. A hair puller, comprising:

a spring actuator having a shaft and a spring; and a body, the shaft being constrained to slide through at least a portion of the body from a first position to a second position, and the body having a first grip and a second grip;

wherein the spring is configured to receive hairs into the spring and to grip the hairs in the spring as the spring moves to a substantially fully compressed configuration as a result of relative movement along a longitudinal direction of the shaft caused by relative movement of the spring actuator and the body, the relative movement along the longitudinal direction of the shaft that results in the spring moving to the substantially fully compressed configuration being caused by forces on the first grip and the second grip, the forces moving the first grip and the second grip substantially perpendicular to a longitudinal axis of the shaft, and the forces being directed substantially perpendicular to the longitudinal axis of the shaft; wherein the relative movement along the longitudinal direction of the shaft comprises an end of the body moving axially along the shaft in a direction toward the spring; and wherein the spring is a helical spring that has a first spring end and a second spring end, the spring being configured to surround the shaft, the first spring end of the spring engaging the shaft.

12. The hair puller of claim 11, wherein:

the shaft has a first actuator end and a second actuator end, the first actuator end having a first actuator end portion extending laterally outward;

the body has a first body end, a middle body portion, and a second body end, the first body end engaging the second spring end and the first body end slidingly coupled with the shaft, the second body end being fixedly coupled to the second actuator end, the middle body portion including the first grip, and the first grip including a bendably resilient element configured to arc away from the shaft when in an open position and the bendably resilient element configured to be pushed towards the shaft in moving from the open position to a closed position, the moving from the open position to the closed position causing the helical spring to become substantially fully compressed.

13. The hair puller of claim 12, wherein the bendably resilient element is a first bendably resilient element, the second grip includes a second bendably resilient element, and the second bendably resilient element is configured to arc away from the shaft when in the open position and the second bendably resilient element is configured to be pushed towards the shaft in moving from the open position to the closed position.

14. The hair puller of claim 11, wherein the spring is a helical spring formed of spring wire and a cross section of the spring wire of the spring is substantially oval.

15. The hair puller of claim 11, wherein an end portion of the shaft extends radially outward to engage the spring and the spring is located axially between the end portion of the shaft and first grip.

16. The hair puller of claim 11, wherein the first grip and the second grip are positioned on opposite sides of the actuator shaft, and wherein a single continuous part comprises the first grip and the second grip.

17. A hair puller, comprising:

a spring actuator having a shaft and a spring; and a body, the shaft being constrained to slide through at least a portion of the body from a first position to a second position, and the body having a first grip and a second grip, the first grip and the second grip being positioned on opposite sides of the shaft;

wherein the spring is configured to receive hairs into the spring and to grip the hairs in the spring as the spring moves to a substantially fully compressed configuration as a result of relative movement along a longitudinal direction of the shaft caused by relative movement of the spring actuator and the body, the relative movement along the longitudinal direction of the shaft that results in the spring moving to the substantially fully compressed configuration being caused by forces on the first grip and the second grip, the forces being directed substantially perpendicular to a longitudinal axis of the shaft;

wherein the relative movement along the longitudinal direction of the shaft comprises an end of the body moving axially along the shaft in a direction toward the spring; and wherein the spring is a helical spring that has a first spring end and a second spring end, the spring being configured to surround the shaft, the first spring end of the spring engaging the shaft.

* * * * *